US005520433A

United States Patent [19]

Tokutake et al.

[11] Patent Number: 5,520,433

[45] Date of Patent: May 28, 1996

[54] MECHANISM FOR ADJUSTING BABY CHAIR HEIGHT

[75] Inventors: Katuhiro Tokutake; Susumu Matsumoto, both of Tokyo, Japan

[73] Assignee: Combi Corporation, Tokyo, Japan

[21] Appl. No.: 263,443

[22] Filed: Jun. 21, 1994

[30] Foreign Application Priority Data

Jul. 21, 1993 [JP] Japan ..... 5-044131 U

[51] Int. Cl.[6] ..... A47C 3/02; A47C 13/00

[52] U.S. Cl. ..... 297/131; 297/344.12; 248/423

[58] Field of Search ..... 297/131, 344.12, 297/344.15, 344.18; 248/421, 423, 277

[56] References Cited

U.S. PATENT DOCUMENTS

| | | | |
|---|---|---|---|
| 1,324,013 | 12/1919 | Sombra | 297/344.15 |
| 3,977,644 | 8/1976 | Sturhan | 248/384 X |
| 4,394,046 | 7/1983 | Irwin et al. | 297/344.15 |
| 5,131,719 | 7/1992 | Kassai | 297/344.18 |
| 5,330,253 | 7/1994 | Kaneko | 248/423 X |

*Primary Examiner*—Peter R. Brown
*Assistant Examiner*—Anthony D. Barfield
*Attorney, Agent, or Firm*—Sughrue, Mion, Zinn, Macpeak & Seas

[57] ABSTRACT

A baby chair height adjusting mechanism which is capable of accurately adjusting the height of a baby chair, and which includes a chair main body two pairs of leg rods respectively mounted to the two side portions of the lower surface of the chair main body such that they can be adjusted in height, each pair including a front leg rod and a rear leg rod, and two height adjusting mechanisms each rotatably mounted on the upper end portion of the front leg rod, each of the height adjusting mechanisms includes a lift lever capable of being lifted and lowered and a lock lever having a lower end portion capable of being advanced and retreated.

21 Claims, 5 Drawing Sheets

MECHANISM FOR ADJUSTING BABY CHAIR HEIGHT

FIELD OF THE INVENTION

The present invention relates to a baby chair and, in particular, to a baby chair which is structured such that the height of leg rods for supporting the chair's main body can be adjusted. The present disclosure is based on the disclosure of Japanese Utility Model Appln. No. Hei 5-44131 filed Jul. 21, 1993, which disclosure is incorporated herein by reference.

BACKGROUND OF THE INVENTION

There is known from Japanese Utility Model Publication No. 4-32148 of Heisei and the like, a baby chair in which the chair's main body includes two pairs of leg rods each comprising a front leg rod and a rear leg rod for supporting the chair's main body. The front and rear leg rods are arranged so as to cross each other in their respective middle portions so as to form an X shape. The upper end portion of one of the front and rear leg rods is pivotally mounted on the lower surface of the main body of the chair, the upper end portion of the other leg rod is pivotally mounted to a slider secured to the lower surface of the chair main body such that it can be slid back and forth, and the height of the leg rods can be adjusted by approaching or separating the upper end potions of the two front and rear leg rods which cross each other to form the X shape.

However, in the leg rod height adjusting mechanism employed in the above-mentioned known baby chair, the slider mechanism is provided in an armrest portion forming part of the baby chair, and therefore the structure of the chair's main body is complicated.

Also, in the above baby chair, most of the mechanism portions are exposed to the outside and therefore such exposed mechanism portions can be touched easily from outside. Accordingly, when the baby chair is in use, there is a danger that the fingertips of a baby will touch the adjusting mechanism, thereby possibly causing an injury to the baby. Further, if a stopper mechanism for removing a stop state is pressed down, then the slider is immediately slid. Therefore, if the stopper mechanism is touched carelessly, then the height of the leg rods can be dangerously changed unexpectedly.

SUMMARY OF THE INVENTION

The present invention is directed at eliminating the drawbacks found in the above-mentioned conventional baby chair height adjusting mechanism. Accordingly, it is an object of the invention to provide a baby chair height adjusting mechanism in which an operation mechanism for adjusting the height of a baby chair is provided in part of the leg rods, thereby simplifying the structure of a baby chair main body and reducing the manufacturing cost of the baby chair.

It is another object of the invention to provide an extremely safe baby chair height adjusting mechanism which is able to function only when a lift lever provided in the height adjusting mechanism is pressed down at the same time the chair main body is lifted. That is, the height adjusting mechanism functions only when these two operations are performed simultaneously. As a result, the height of the leg rods is prevented from being adjusted unexpectedly.

In attaining the above objects, according to the invention, there is provided a baby chair height adjusting mechanism which comprises a chair main body, two pairs of leg rods mounted opposite to each other on the two sides of the lower surface of the chair main body in such a manner that they can be adjusted in height, each pair of leg rods comprising a front leg rod and a rear leg rod, and two height adjusting mechanisms respectively mounted on the upper end portions of the front leg rods in such a manner that the mechanisms can be rotated. In the baby chair height adjusting mechanism, the leg rods are structured such that the front and rear leg rods cross each other in the central portions thereof, the crossing portions thereof are connected to each other such that they can be pivotally moved, and the upper end portion of each of the rear leg rods is pivotally mounted on the front lower surface of a seat portion forming part of the chair main body. Each of the height adjusting mechanisms includes, within a frame case, a lift lever which is liftable and lowerable by a given distance and a lock lever the lower end portion of which can be moved back and forth in linking with the lifting and lowering movements of the lift lever. The lift lever includes a lever main body long lengthways, an operation knob provided on the lever main body such that it projects laterally from the lever main body, and a U-shaped rod holding portion provided on the lower end portion of the lever main body in such a manner that it projects in the opposite direction to the projecting direction of the operation knob, the U-shaped rod being able to be fit with the end portion of a height adjusting rod. The lock lever is arranged such that the lower end portion thereof is bent to form an L shape so as to serve as a receiving portion for receiving the height adjusting rod. At the same time, the lock lever is arranged such that the end portion of the height adjusting rod, the two end portions of which are swingably extended between and held by the two mutually opposing height adjusting mechanisms, can be fitted with and supported by the rod holding portion of the lift lever and the rod receiving portion of the lock lever, and such that the bar-like shaft rod portion of the height adjusting rod can be selectively fitted into any of a large number of different fitting recessed grooves respectively formed in the lower surface of the seat portion of the chair main body.

DESCRIPTION OF THE PREFERRED EMBODIMENTS

A description will now be given hereinbelow of the embodiments of a baby chair height adjusting mechanism according to the invention with reference to the accompanying drawings.

Figure 1:
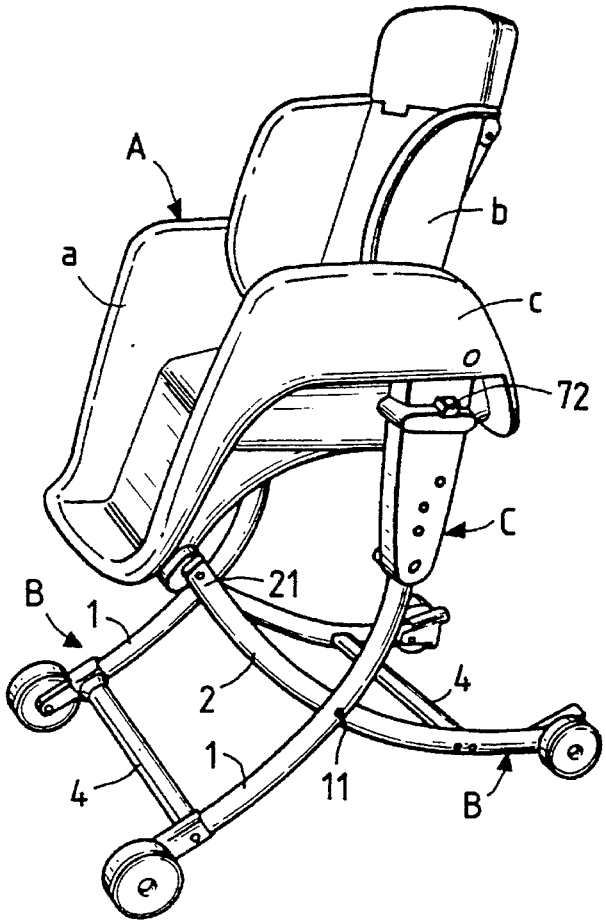
FIG. 1 is a perspective view of a baby chair, showing a state in which the leg rods of the baby chair are set high.

As shown in the embodiment of FIG. 1, a baby chair according to the invention includes a chair main body A, two pairs of leg rods B, B which are respectively mounted on the two sides of the lower surface of the chair main body A in such a manner that they are mutually opposed to each other and can be adjusted in height, and two height adjusting mechanisms C, C which are respectively mounted rotatably on the upper end portions of the respective front leg rods B. The chair main body A is of a known type and it includes a reclining structure in which the lower end portion of a backrest portion b is pivotally mounted on the rear end portion of a seat portion a forming part of the chair main body A in such a manner that the backrest lower end portion can be raised and lowered.

In each of the two pairs of leg rods B, B, a front leg rod 1 and a rear leg rod 2 are made to cross each other in the middle portions thereof, the crossing portions are pivotally connected to each other by means of a pivot 11 in a manner so as to form an X shape. The upper end portion of the rear leg rod 2 is pivotally secured to the lower surface of the leading end portion of the chair main body A by means of a pivotal shaft 21, and the upper end portion of the front leg rod 1 is pivotally and swingably secured to the lower end portion of each of the height adjusting mechanisms C, C which are pivotally and swingably mounted to the rear portion of an armrest portion c forming part of the chair main body A.

Figure 3:
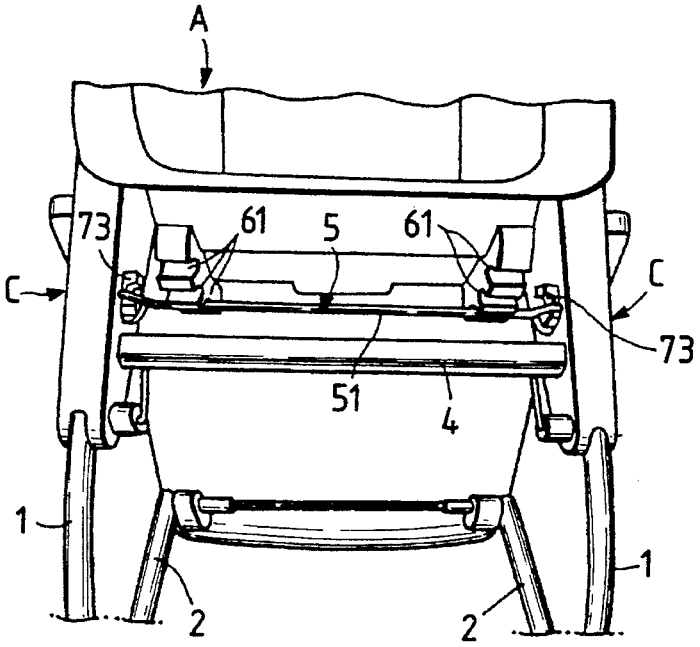
FIG. 3 is a perspective back view of a chair main body, showing a state in which a height adjusting rod extended between two height adjusting mechanisms is fitted into one of the fitting recessed grooves.

As shown in FIGS. 1 and 3, there are extended three connecting rods 4, 4, 4 respectively disposed between a pair of mutually opposing front leg rods 1, 1, between a pair of mutually opposing rear leg rods 2, 2, and between a pair of mutually opposing height adjusting mechanisms C, C (FIG. 3). The connecting rods 4 are used to maintain the mutual distance between the leg rods B, B as well as between the height adjusting mechanisms C, C, and also to maintain the strength and stability thereof.

Figure 4:
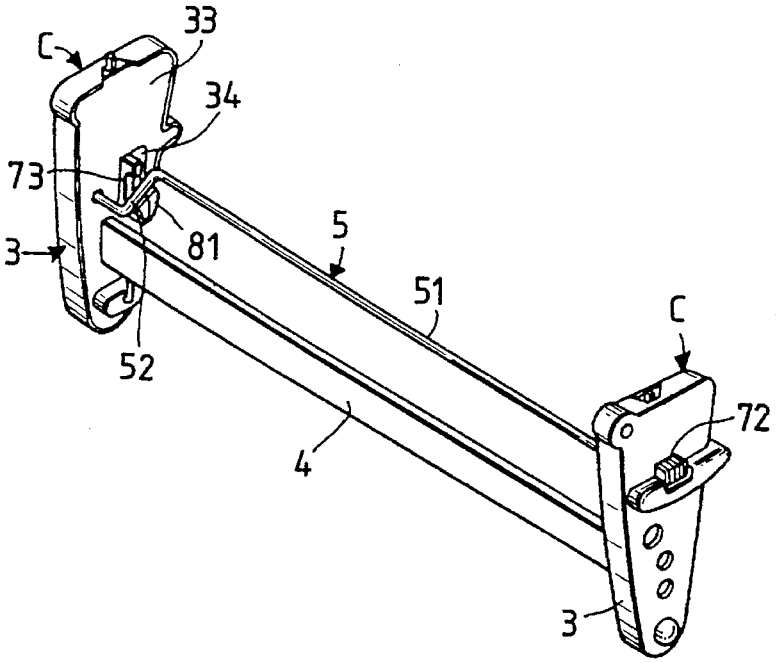
FIG. 4 is an enlarged perspective view of a height adjusting mechanism.

As shown in FIGS. 3 and 4, reference character 5 designates a height adjusting rod which is swingably extended between the height adjusting mechanisms C and C and includes an inverted-U shaped shaft rod 51. The shaft rod 51 includes on the two end portions thereof two securing portions 52, 52 which are respectively bent so as to form an L-shape, and so that the rod 5 has as whole, crank-like shape. The L-shaped bent securing portions 52, 52 are swingably mounted on the inside portions of the height adjusting mechanisms C, C, and the rod-shaped portions of the shaft rod 51 can be selectively fitted into any of several different fitting recessed grooves 61—61 which are respectively formed in two sides of the lower surface of the seat portion a. (See FIGS. 3 and 4).

Figure 2:
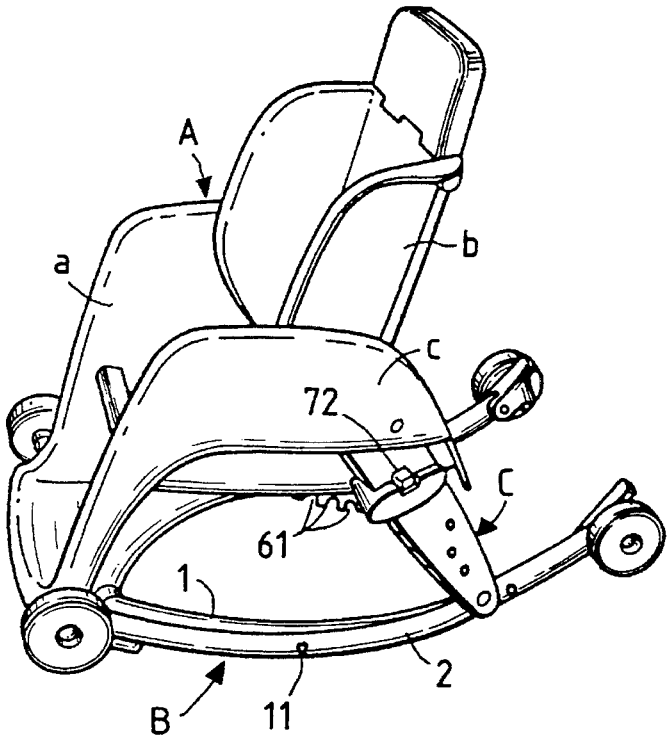
FIG. 2 is a perspective view of a baby chair, showing a state in which the leg rods of the baby chair are set low.

The fitting recessed grooves 61—61 are formed on the two sides of the lower surface of the seat portion a at suitable intervals from one another in the longitudinal direction thereof, and are arranged such that, by selecting the fitting portions between the height adjusting rod 5 and fitting recessed grooves 61—61 to thereby adjust the distance between the front and rear leg rods 1 and 2, the height of the baby chair can be adjusted. For example, when the height adjusting rod 5 is fit with the forefront fitting recessed groove 61, the front leg rod 1 and rear leg rod 2 provide an X shape which is long lengthways to set the chair at the high position thereof, as shown in FIG. 1. On the other hand, when the rod 5 is fit with the rearmost fitting recessed groove 61, the front leg rod 1 and rear leg rod 2 provide a flattened X shape, as shown in FIG. 2, in which the two leg rods 1 and 2 are arranged as if they were a bow, and thus the chair is set in a position so as to form a rocking chair.

Figure 5:
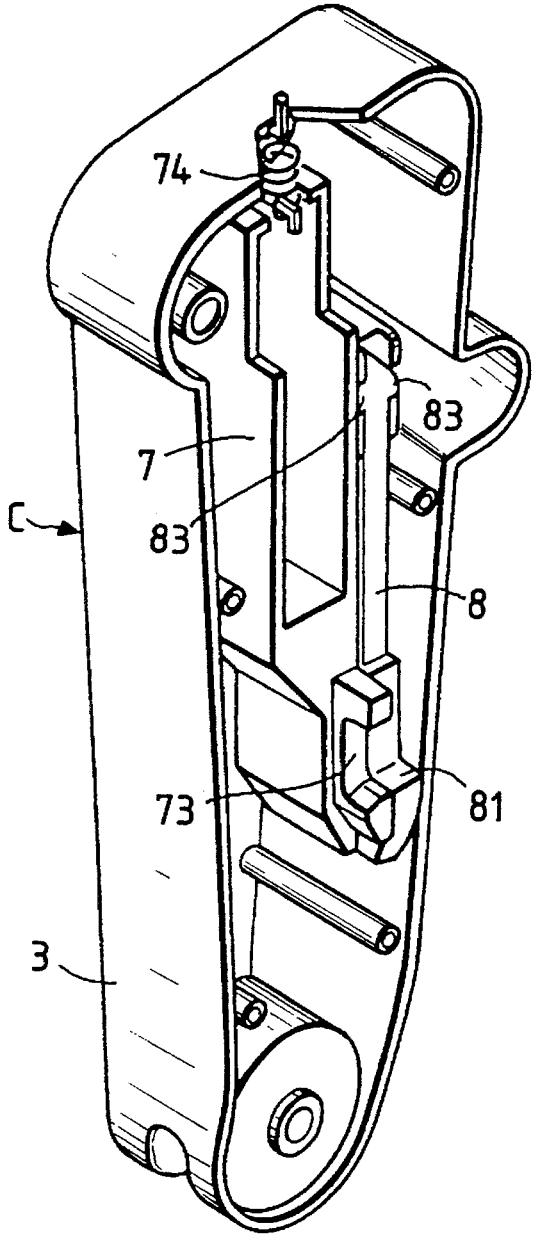
FIG. 5 is a perspective view of the above height adjusting mechanism with its back cover removed.

Referring to FIGS. 4 and 5, in each of the height adjusting mechanisms C, C there is mounted, within the frame case 3, a lift lever 7 arranged to be liftable and lowerable by a given distance and a lock lever 8, the lower end portion of which can be moved back and forth in linking with the lifting and lowering movements of the lift lever 7.

The lift lever 7 includes a lever main body 71 (FIGS. 6–7) formed long lengthways, an operation knob 72 provided in the upper portion of the lever main body 71 and projected laterally therefrom, and a U-shaped rod holding portion 73 formed in the lower end portion of the lever main body 71 and projected in the opposite direction to the projecting direction of the operation knob 72 so as to be fittable with the end portion of the height adjusting rod 5.

The operation knob 72 which projects laterally from the upper portion of the lift lever 7 extends toward the front side of the frame case 3, while the U-shaped holding portion 73 (FIGS. 5–7) projects oppositely from the lower end portion of the lift lever 7 and extends toward the back side of the frame case 3.

Figure 7:
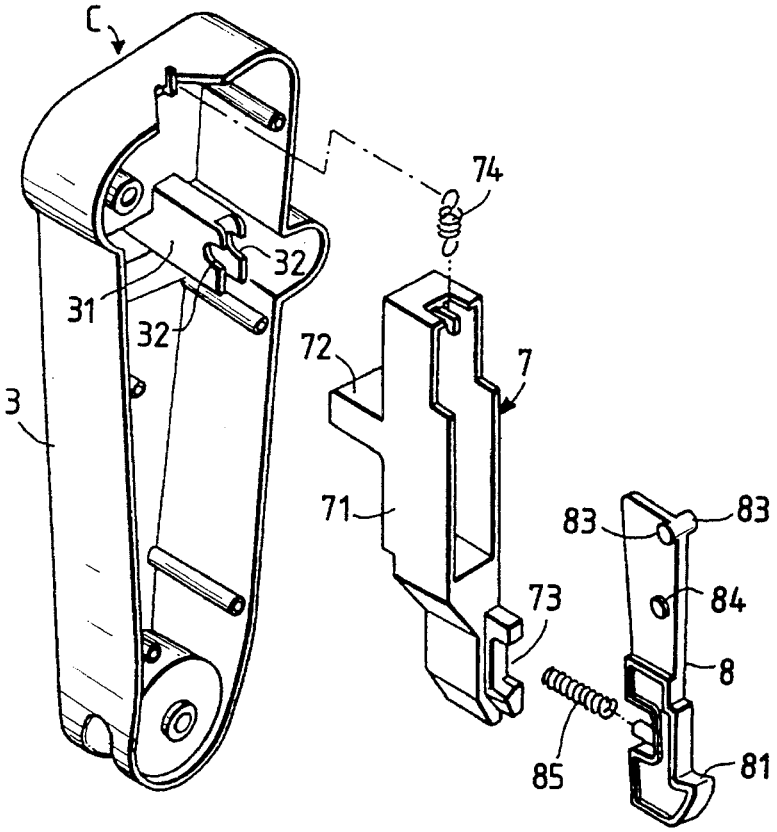
FIG. 7 is an exploded perspective view of the height adjusting mechanism.
Figure 9:
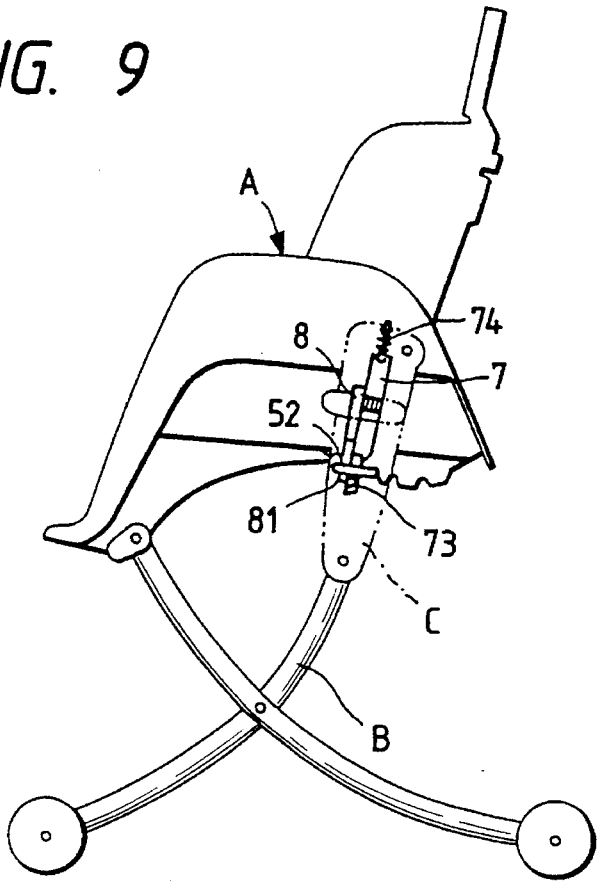
FIG. 9 is an explanatory view of a baby chair, showing the lifting operation of the height adjusting mechanism.

As shown in FIGS. 5, 7 and 9, reference character 74 designates a lifting spring for the lift lever 7. The lifting spring 74 extends between the frame case 3 and lift lever 7 in such a manner that the spring 74 can apply a contracting force, whereby the lifting spring 74 always energizes the lift lever 7 in the lifting direction.

The lock lever 8 is formed of a thin plate-shaped member and includes a lower end portion which is bent to form an L shape, thereby serving as a receiving portion 81 for receiving the height adjusting rod 5 (FIG. 7). The lock lever 8 includes two securing shafts 83, 83 which project in opposite directions to each other in a manner to cross the base end portion of the lock lever 8. The securing shafts 83, 83 can be fitted into and pivotally supported by fitting grooves 32, 32 respectively formed in a support rod 31 which projects from the frame case 3.

The reference numeral 84 refers to a drive force transmission projection which is used to advance and retreat the lower end portion of the lock lever 8. The leading end portion of the projection 84 is fitted into a triangle-shaped drive guide groove 75 (FIG. 6) which is formed in the side surface of the lift lever 7.

Figure 6:
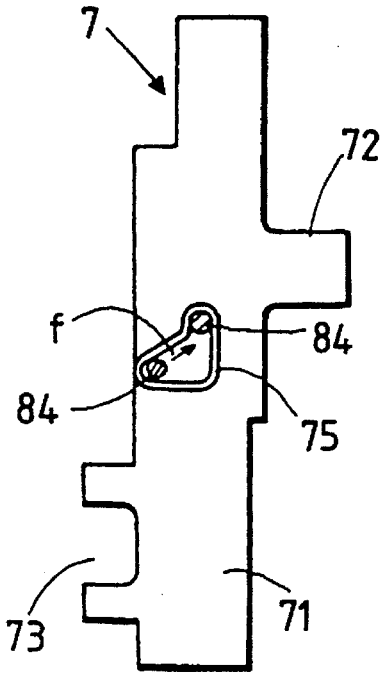
FIG. 6 is a side view of a lift lever, showing a drive guide groove formed in the side surface of the lift lever.

The drive force transmission projection 84, as shown in FIG. 6, is normally situated in the lower portion of the drive guide groove 75. When the lift lever 7 is moved down, the projection 84 is retreated in a direction of an arrow f along the inclination of the drive guide groove 75, so that the receiving portion 81 provided in the lower end portion of the lock lever 8 for receiving the height adjusting rod can be retreated into the frame case 3.

A spring 85, used to push out the lock lever 8, is mounted in such a manner that it has an elastic force. Therefore, the spring 85 can always energize the lower end portion of the lock lever 8. That is, the height adjusting rod receiving portion 81 of the lock lever 8 is energized by spring 85 in a direction to push out the same externally of the frame case 3 (i.e., in the backward direction of the frame case 3).

The reference numeral 33 refers to a back cover for covering the back surface of the frame case 3 (FIG. 4). The back cover 33 includes an opening 34 having a size such that the U-shaped holding portion 73 provided in the lower end portion of the lift lever 7 and the L-shaped receiving portion 81 formed in the lower end portion of the lock lever 8 for receiving the height adjusting rod 5 are allowed to project out through the opening 34 and also the U-shaped holding portion 73 is allowed to slide therethrough.

When the leg rods B, B of the baby chair main body A are set high, as shown in FIG. 1, and also when they are set low, as shown in FIG. 2, the height adjusting rod 5 is set between the height adjusting mechanisms C and C of the baby chair main body A, the L-shaped bent securing portions 52, 52 respectively formed in the two end portions of the height adjusting rod 5 are fitted with the U-shaped rod holding portions 73, 73 provided in the lower end portion of the lift lever 7 and are also supported on the rod receiving portion 81 provided in the lower end portion of the lock lever 8 (See FIG. 4).

The bar-like shaft rod 51 portions of the height adjusting rod 5 which has a crank shape are selectively fitted into any one of the fitting recessed grooves 61—61 respectively formed in the two side portions of the lower surface of the seat portion a (See FIG. 3).

When adjusting the height of the baby chair, at first, the right and left operation knobs 72 respectively provided in the upper portion of the lift lever 7 are pressed down and the rod receiving portion 81 formed in the lower end portion of the lock lever 8 retreats into the frame case 3, thereby releasing the support of the height adjusting rod 5 by the lock lever 8.

Figure 8:
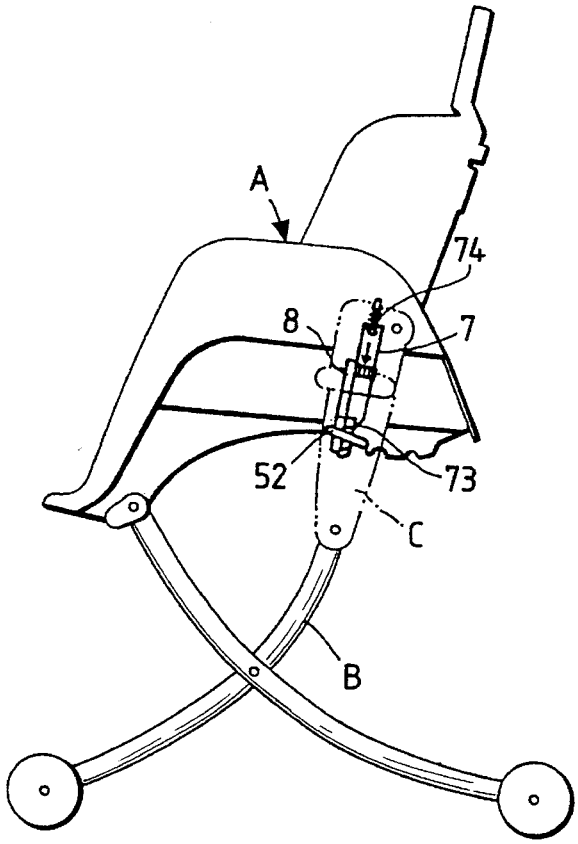
FIG. 8 is an explanatory view of a baby chair, showing the lowering operation of the height adjusting mechanism.

When the support of the height adjusting rod 5 by the lock lever 8 is released, the height adjusting rod 5 becomes supported only by the U-like shaped rod holding portion 73 in the lower end portion of the lift lever 7. If the lift lever 7 is thereafter pressed down, then the support of the height adjusting rod 5 by the lower portion of the U-shaped rod holding portion 73 is also removed so that the bar-like shaft rod 51 portions can be moved down and swung within the range of the groove width of the U-shaped holding portion 73 (See FIG. 8).

After the above operations are performed, with the operation knobs 72 of the lift lever 7 remaining depressed, if the baby chair A is lifted, then the height adjusting rod 5 is lowered down due to its own weight in the range of the groove width of the U-shaped rod holding portion 73 formed in the lower end portion of the lift lever 7, which removes the engagement between the shaft rod 51 portions of the height adjusting rod 5 extended between the height adjusting mechanisms C and C and the fitting recessed grooves 61, 61 formed in the two sides of the lower surface of the seat a (See FIG. 9).

Figure 10:
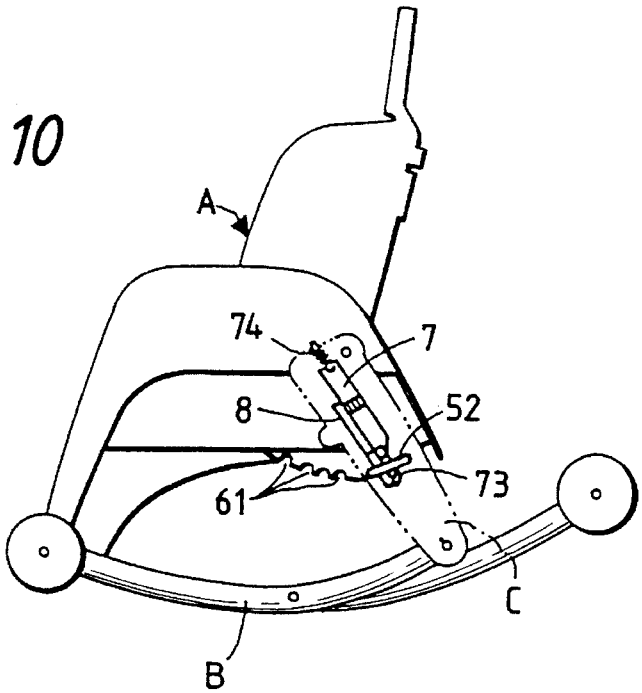
FIG. 10 is an explanatory view of a baby chair, showing the completion of the height adjusting mechanism.

After the engagement between the height adjusting rod 5 and the fitting recessed grooves 61—61 is removed, if the baby chair A is lifted up or pressed down to a desired position, then the baby chair A can be simply changed to a desired height (See FIG. 10).

According to the invention as described above, after the lift lever 7 provided in the height adjusting mechanism C is pressed down, unless the baby chair A is lifted up to thereby remove the engagement between the securing recessed grooves 61—61 and the height adjusting rod 5, the chair main body A cannot be pushed down. This dual operation safety arrangement eliminates the danger that the baby chair can be unexpectedly and unnecessarily lifted up or lowered down.

Further, since the height adjusting mechanism C includes a lift lever 7 which is capable of lifting and lowering movements with a lock lever 8 having a lower end portion which is capable of advancing and retreating, even if the lift lever 7 is inadvertently pressed down, the rod receiving portion 81 formed in the lower end portion of the lock lever 7 is prevented against rising and falling movements thereof. This arrangement assures that the height adjusting rod 5 can always be supported by the rod receiving portion, which can avoid the possibility that the unexpected rising and falling movements of the lower end portion of the lock lever 7 causes any problems.

In addition, because the drive force transmission projection 84 is provided in the side surface of the lock lever 8 and is fitted into the drive guide groove 75 formed in the side surface of the lift lever 7, it is ensured that the lock lever 8 can be advanced and retreated accurately in linking with the lifting and lowering movements of the lift lever 7.

What is claimed is:

1. A baby chair height adjusting mechanism comprising:

a chair main body;

two pairs of leg rods adjustable in height and mounted mutually oppositely on the two side portions of a lower surface of the chair main body; and two height adjusting mechanisms rotatably mounted on respective upper end portions of front leg rods of the paired leg rods;

wherein said leg rods are arranged such that said front and rear leg rods cross each other at central portions thereof, said crossing central portions being pivotally supported, and upper end portions of said rear leg rods being pivotally mounted on a front lower surface of a seat portion of said chair main body; said height adjusting mechanisms each includes, within a frame case, a lift lever for rising and falling by a given distance, and a lock lever having its lower end portion movable back and forth in linking relationship with the rising and falling movements of said lift lever; said lift lever includes an operation knob provided in an upper portion of a lever main body which projects laterally, and a U-shaped rod-holding-portion supporting a height adjusting rod having two end portions, said rod-holding-portion is provided in the lower end portion of said lever main body and projects in an opposite direction to the projecting direction of said operation knob, said lock lever includes a lower end portion which is bent to form an L shape and which serves as a rod receiving portion for receiving an end portion of said height adjusting rod; the two end portions of said height adjusting rod are swingably held on said two opposing height adjusting mechanisms, the end portion of said height adjusting rod is fitted with and supported by said U-shaped rod-holding-portion of said lift lever and said rod receiving portion of said lock lever, and wherein said height adjusting rod can be selectively fitted with one of a plurality of fitting recessed grooves formed in the lower surface of said seat portion of said chair main body.

2. A baby chair height adjusting mechanism as set forth in claim 1, further comprising means for continuously applying a force to lift said lift lever.

3. A baby chair height adjusting mechanism as set forth in claim 1, further comprising means for continuously applying a force which serves to project said lock lever away from said frame case.

4. A baby chair, comprising:

a chair main body section;

a back rest portion connected to said chair main body section;

leg rods for supporting said chair main body section;

a height adjusting mechanism coupled to said leg rods for adjusting a height of said leg rods, said height adjusting mechanism including opposing lift levers each having a U-shaped rod-holding-portion which projects from a lower portion of said lift lever, and;

a height adjusting rod having end portions which are adapted to be fitted with and supported by said U-shaped rod-holding portion of said lift levers, wherein said height adjusting mechanism is operable only if said lift levers are pressed down at a same time that said chair main body is lifted.

5. The baby chair as defined in claim 4, wherein said leg rods comprise a pair of front leg rods and a pair of rear leg rods, and wherein said pair of front legs are pivotally connected to said pair of rear leg rods.

6. The baby chair as defined in claim 4, wherein said height adjusting mechanism comprises a pair of height adjusting units mounted on respective leg rods.

7. The baby chair as defined in claim 6, wherein each of said height adjusting units includes one of said lift levers, each of said lift levers being movable in an up and down direction by a given distance, and a lock lever which is movable back and forth in a direction substantially perpendicular to said up and down direction in a linking relationship with said up and down movements of said lift lever.

8. The baby chair as defined in claim 7, wherein said lock lever comprises a thin plate-shaped member.

9. The baby chair as defined in claim 8, wherein said lock lever further comprises an L-shaped lower end portion.

10. The baby chair as defined in claim 9, wherein said lock lever further comprises a drive force transmission projection for retreating and advancing said L-shaped lower end portion into said height adjusting unit, and wherein each of said lift levers further includes a drive guide groove formed in a side surface thereof for receiving said drive force transmission projection.

11. The baby chair as defined in claim 10, wherein said drive guide groove is triangularly shaped, and wherein said drive force transmission projection moves in said guide groove when said lift lever is moved.

12. The baby chair as defined in claim 4, wherein each of said lift levers includes a main body portion, and an operation knob which projects from an upper portion of said main body portion.

13. The baby chair as defined in claim 12, wherein said height adjusting rod has end portions which are adapted to be fitted with the U-shaped rod holding portions of said lift levers.

14. A baby chair, comprising:

a chair main body section;

a back rest portion connected to said chair main body section;

leg rods for supporting said chair main body section;

a height adjusting mechanism coupled to said leg rods for adjusting a height of said leg rods including opposing lift levers each having a main body portion, an operation knob which projects from an upper portion of said main body portion, and U-shaped rod-holding-portion which projects from a lower portion of said main body portion; and a height adjusting rod having end portions which are adapted to be fitted with and supported by said U-shaped rod-holding-portions of said lift levers.

15. A baby chair, comprising:

a chair main body section;

a back rest portion connected to said chair main body section;

leg rods for supporting said chair main body section;

a height adjusting mechanism coupled to said leg rods for adjusting a height of said leg rods including a pair of height adjusting units mounted on respective leg rods, said height adjusting units include a lift lever which is movable in an up and down direction by a given distance, and a lock lever which is movable back and forth in a direction substantially perpendicular to said up and down direction in a linking relationship with said up and down movements of said lift lever, said lift lever having a main body portion, an operation knob which projects from an upper portion of said main body portion, and a U-shaped rod-holding-portions which projects from a lower portion of said main body portion; and a height adjusting rod having end portions which are adapted to be fitted with and supported by said U-shaped rod holding portions of said lift levers.

16. A baby chair, comprising:

a chair main body section;

a back rest portion connected to said chair main body section;

leg rods for supporting said chair main body section;

a height adjusting mechanism coupled to said leg rods for adjusting a height of said leg rods comprising a pair of height adjusting units mounted on respective leg rods, each of said height adjusting units includes a lift lever which is movable in an up and down direction by a given distance and a lock lever which is movable back and forth in a direction substantially perpendicular to said up and down direction in a linking relationship with said up and down movements of said lift lever, said lift lever includes a drive guide groove formed in a side surface thereof, said lock lever comprises a thin plate-shaped member, an L-shaped lower end portion, and a drive force transmission projection which is disposed in said drive guide groove, said drive guide groove and said drive force transmission projection for retreating said L-shaped lower end portion into said height adjusting unit.

17. The baby chair as defined in claim 16, wherein said drive guide groove is triangularly shaped, and wherein said drive force transmission projection moves in said guide groove when said lift lever is moved.

18. A baby chair, comprising:

a chair main body section;

a back rest portion connected to said chain main body section;

leg rods for supporting said chair main body section;

a height adjusting mechanism connected to said leg rods for adjusting a height of said leg rods, said height adjusting mechanism including opposing lift levers each having a U-shaped rod-holding-portion which projects from a lower portion of said lift levers; and a height adjusting rod having end portions which are adapted to be fitted with and supported by said U-shaped rod-holding-portion of said lift levers.

19. The baby chair as defined in claim 18, wherein said height adjusting mechanism is operable only if said lift levers are pressed down at the same time that said chair main body section is lifted.

20. The baby chair as defined in claim 18, wherein said height adjusting mechanism comprises a pair of height adjusting units each mounted on a different one of said leg rods.

21. The baby chair as defined in claim 20, wherein each of said height adjusting units includes one of said lift levers, each of said lift levers being movable in an up and down direction by a given distance, and a lock lever which is movable back and forth in a direction substantially perpendicular to said up and down direction in a linking relationship with said up and down movement of said lift lever.

* * * * *